United States Patent [19]

Schmidt

[11] 4,336,955

[45] Jun. 29, 1982

[54] SAFETY SKI BINDING

[75] Inventor: Hans Schmidt, Neu-Germering, Fed. Rep. of Germany

[73] Assignee: Hannes Marker, Garmisch-Partenkirchen, Fed. Rep. of Germany

[21] Appl. No.: 170,675

[22] PCT Filed: Feb. 6, 1979

[86] PCT No.: PCT/EP79/00008

§ 371 Date: Oct. 6, 1979

§ 102(e) Date: Oct. 5, 1979

[87] PCT Pub. No.: WO79/00591

PCT Pub. Date: Aug. 23, 1979

[30] Foreign Application Priority Data

Feb. 6, 1978 [DE] Fed. Rep. of Germany ..... 2804986

[51] Int. Cl.[3] ..... A63C 9/08

[52] U.S. Cl. ..... 280/618; 280/636

[58] Field of Search ..... 280/618, 620, 617, 616, 280/627, 634, 632, 623, 626, 611, 613, 631, 636

[56] References Cited

U.S. PATENT DOCUMENTS

| | | | |
|---|---|---|---|
| 3,079,163 | 2/1963 | Beausacq | 280/616 |
| 3,489,424 | 1/1970 | Gertsch et al. . | |
| 3,690,690 | 9/1972 | Marker | 280/611 |
| 3,773,341 | 11/1973 | Mimeur . | |
| 3,778,073 | 12/1973 | Salomon . | |
| 3,810,644 | 5/1974 | Beyl . | |
| 3,909,023 | 9/1975 | Zoor | 280/632 |
| 3,937,480 | 2/1976 | Korger | 280/618 |
| 3,966,218 | 6/1976 | Beyl | 280/618 |
| 3,989,274 | 11/1976 | Weigl et al. | 280/634 |
| 4,033,603 | 7/1977 | Horn | 280/618 |
| 4,095,814 | 6/1978 | Weigl | 280/618 |
| 4,185,852 | 1/1980 | Himmetsberger et al. | 280/618 |
| 4,190,264 | 2/1980 | Himmetsberger et al. | 280/618 |

FOREIGN PATENT DOCUMENTS

| | | | |
|---|---|---|---|
| 2603959 | 8/1976 | Fed. Rep. of Germany | 280/618 |
| 1417706 | 10/1965 | France | 280/618 |
| 2349349 | 11/1977 | France | 280/618 |
| 460610 | 8/1969 | Switzerland . | |

*Primary Examiner*—David M. Mitchell

*Attorney, Agent, or Firm*—Squire, Sanders & Dempsey

[57] ABSTRACT

In a safety ski binding, a sole plate secured against lifting off is rotatably mounted on the ski surface in the heel region of the ski boot on a pivot extending perpendicular to the ski surface. The sole plate has a toe holder at its front end and a spring-loaded automatic heel mechanism for the ski boot at its rear end that opens to release the ski boot on the occurrence of a frontal fall load exceeding the spring resistance. To obtain complete release of the ski boot from the sole plate and thus from the ski on the occurrence of an excessive rotary fall load and for returning the sole plate to its normal position after the ski boot has been released, the sole plate has a slideway in the toe region as well as the heel region of the ski boot for securing the sole plate against lifting off and the automatic heel mechanism has a second degree of movement. Release of the ski boot is effected after the resistance of a separate spring has been overcome.

4 Claims, 6 Drawing Figures

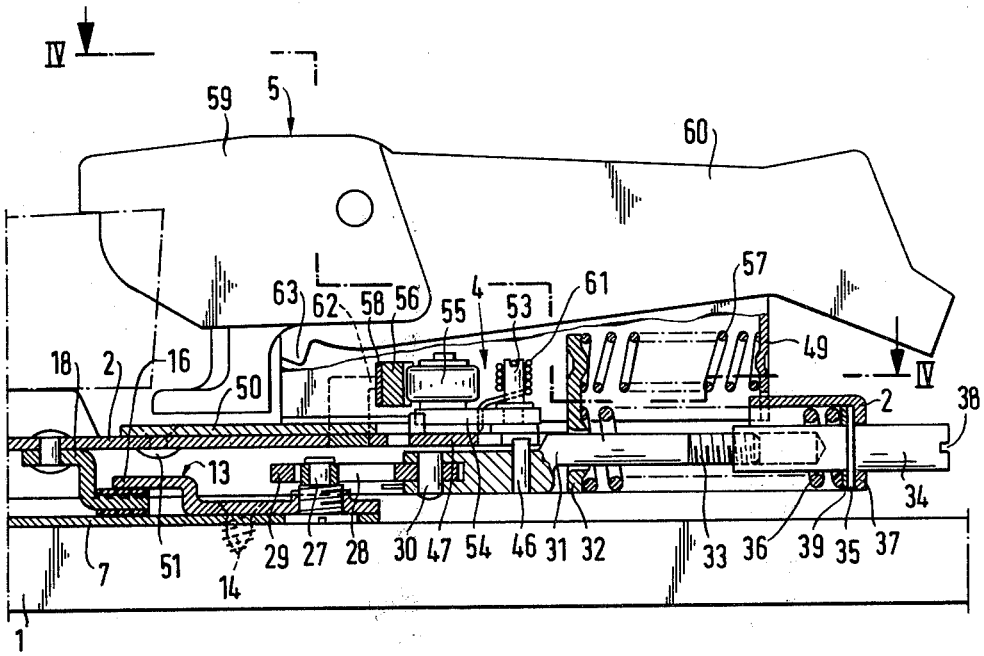
Fig.3
Fig.4
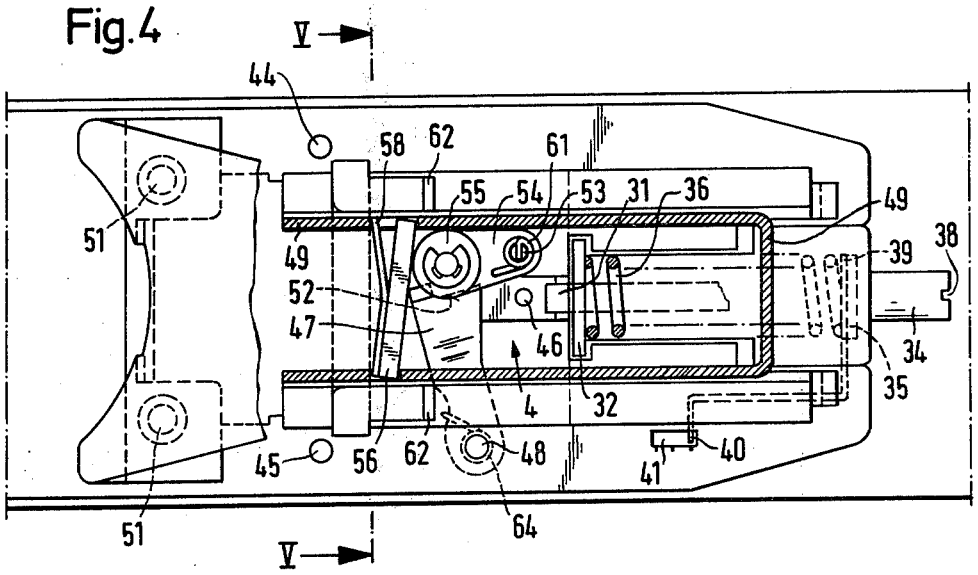

SAFETY SKI BINDING

The invention relates to a safety ski binding comprising a sole plate which is rotatably mounted on the ski surface in the heel region of the ski boot on a perpendicular pivot, is secured against lifting off, has a toe holder at its front end and has at its rear end a spring-loaded automatic heel mechanism for the ski boot that opens to release the ski boot on the occurrence of a frontal fall load exceeding the spring resistance.

In such a safety ski binding known from Swiss Pat. No. 460 610, the toe holder applied to the sole plate has no safety function whatsoever but only serves as a counterbearing for the ski boot. Instead, the safety function on rotary fall loading by the skier is assumed by a spring-loaded latch element which is secured to the ski and which at the same time holds the sole plate in its normal position parallel to the ski.

An important disadvantage of this safety ski binding is the fact that the ski boot and thus the skier remains connected to the ski during a rotary crash release and is therefore still subjected to the risk of injury. In addition, there is the danger that, on strong secondary impact of the ski with the ground, the lever effect of the ski boot, which may have been twisted at right-angles to the length of the ski, the sole plate connected to the ski only by the rotary bearing is torn off the ski.

Further, after such swivelling of the sole plate it is extremely cumbersome and laborious to revert to a condition ready for skiing because the skier must generally first open the automatic heel mechanism, for example with the ski stick, so as to release the ski boot, then swing the sole plate to the normal position by hand against the resistance of the latch element, whereafter it is at least possible to step into the binding again.

It is therefore the problem of the present invention to provide a safety ski binding of the stated kind in which there is complete release of the ski boot from the sole plate and thus from the ski on excessive rotary fall loading and wherein after release of the ski boot the sole plate is again automatically swung to its normal position parallel to the ski.

Based on a safety ski binding in accordance with the present invention, this is achieved in that the sole plate has a slideway in the toe as well as in the heel region of the ski boot for securing the sole plate against lifting off and that the automatic heel mechanism is designed to release the ski boot on the occurrence of an excessive rotary fall load and release takes place after overcoming the resistance of a separate spring.

This also avoids the disadvantage of a constant ratio between the releasing resistance for frontal and rotary fall loading—a disadvantage inherent with many plate bindings which, however, become released from the ski together with the ski boot.

A separate degree of movement for the automatic heel mechanism to release the ski boot on the occurrence of an excessive rotary fall load is achieved if the automatic heel mechanism is hinged to a housing and the housing is displaceable on the sole plate lengthwise of the ski.

In this case it has been found desirable for a lock controlled in dependence on the rotary angle of the sole plate to be provided between the housing and the sole plate.

A particularly rapid release of the automatic heel mechanism on reaching the excessive rotary fall load is ensured if a helical compression spring is provided which is supported on the sole plate and acts on the housing of the automatic heel mechanism in the opening sense.

In a constructional embodiment of the invention, the automatic heel mechanism comprises a freeing lever provided with a lug which forms the counter abutment for an abutment on the sole plate limiting the displacement of the housing. In this way, in the case of a rotary fall release when the heel retainer has to be opened to permit stepping into the binding again the retainer is automatically displaced on the ski to the stepping in position together with its housing.

Particularly for the purpose of enabling a safety ski binding according to the invention to be removed from the skis during transport on the one hand and also for use on second or third skis on the other hand, the sole plate is mounted on the ski for deliberate removal. This can for example be effected by means of a bayonet connection.

In order effectively to protect the releasing mechanism from the entry of any snow, water, dirt or the like without detrimentally influencing its safety function, a particular suggestion of the invention provides for the automatic heel mechanism to be surrounded up to its sole retainer by a preferably flexible plastics wall which at least sealingly abuts the ski surface or a carrier element of the binding.

One example of the invention will now be described in detail with reference to the accompanying drawings, wherein:

FIG. 3 is a continuation of FIG. 1 showing the rear portion of the safety ski binding;

FIG. 4 is a continuation of FIG. 2 showing the same portion as FIG. 3;

Figure 1:
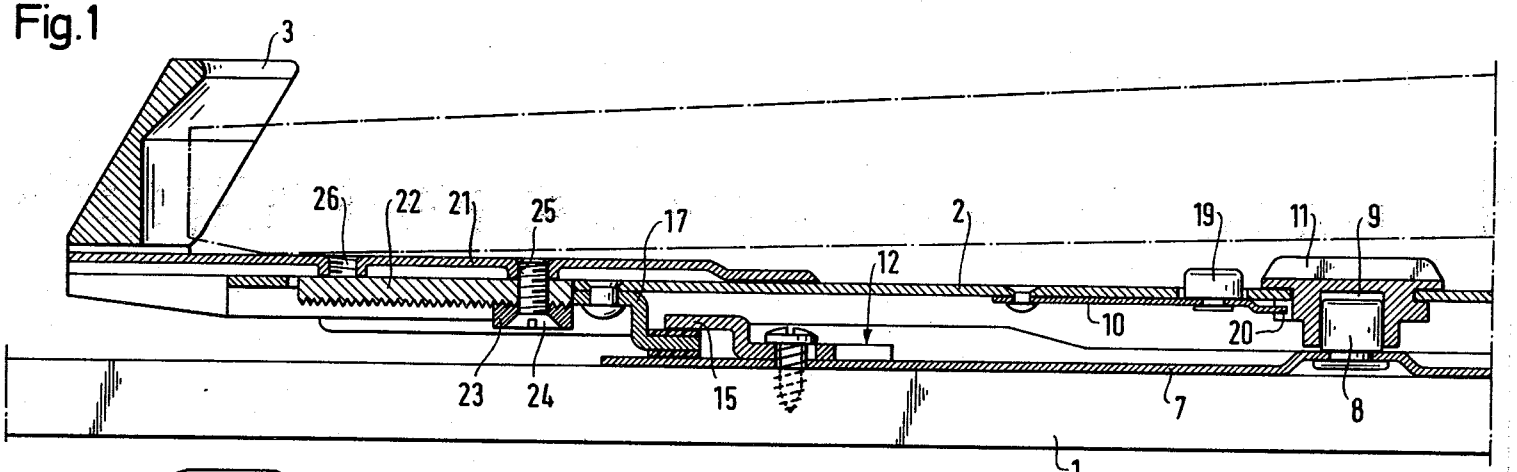
FIG. 1 is a longitudinal section of the front portion of the safety ski binding with the sole of the ski boot shown in chain-dotted lines.
Figure 2:
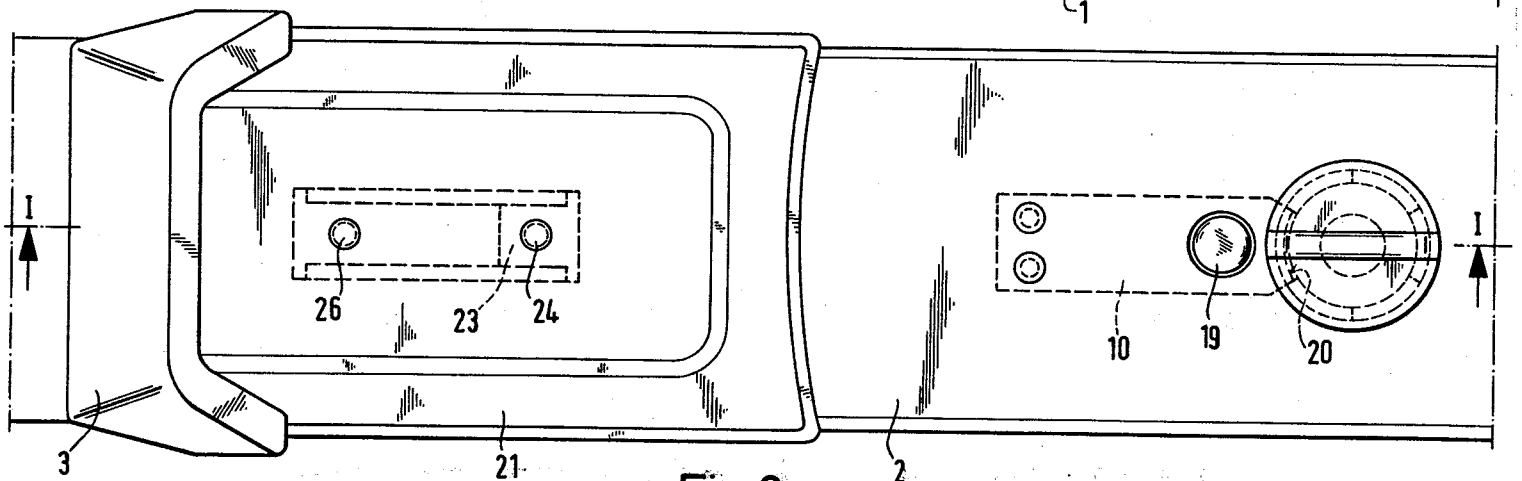
FIG. 2 is a plan view of the same portion as in FIG. 1.

The safety ski binding according to the present invention shown in the drawings substantially comprises a sole plate 2 which is rotatably mounted on a ski 1 and carries a toe holder 3 at its left-hand end in relation to FIGS. 1 and 2, a locking mechanism 4 at its right-hand end shown in FIGS. 3 and 4 and, thereabove, an automatic heel mechanism 5 which opens on excessive frontal loading by the skier and is conventional in this respect. Examples of such automatic heel mechanisms are described in U.S. Pat. Nos. 3,773,341, 3,778,073, and 3,810,644. Another spring-loaded automatic heel mechanism for a ski boot that opens to release the ski boot on the occurrence of a frontal fall load exceeding the spring resistance is described in U.S. Pat. No. 3,909,023.

The mounting of the sole plate 2 (see FIGS. 1 and 2) consists of a pivot pin 8 secured to a base plate 7 and a bearing hole 9 of a bayonet coupling 11 which is secured in the sole plate by a leaf spring 10. The base plate 7 together with a respective angle 12, 13 which is Z-shaped in relation to FIGS. 1 and 3 is secured to the ski 1 by means of screws 14. The free ends 15, 16 of the Z-shaped angles 12, 13 pointing towards the toe holder 3 secure the sole plate 2 against lifting off by means of a respective angle 17, 18 which is riveted to the sole plate and is likewise Z-shaped in relation to FIGS. 1 and 3.

For the deliberate removal of the sole plate 2, one depresses a button 19 which is secured to the leaf spring 10 and projects through a hole of the sole plate, so that the free end 20 of the leaf spring which blocks automatic turning of the bayonet coupling 11 releases same. The bayonet coupling can now be turned through 60° and subsequently removed from the pivot pin 8. By displacing the sole plate 2 through a few millimeters towards the tip of the ski, the Z-shaped angles 17, 18 are freed from the overlapping ends 15, 16 of the angles 12, 13 and the sole plate can be taken off the ski. Mounting of the sole plate is effected in the reverse sequence but, when the bayonet closure is inserted, it depresses the free end 20 of the leaf spring and actuation of the button 19 is therefore superfluous.

The toe holder 3 is rigidly connected to a supporting member 21 which laterally overlaps the sole plate 2 and is adjustably mounted to adapt the safety ski binding to different boot sizes. The adjustment is effected in steps by way of a rack 22 which is provided on the sole plate 2 and into which a serrated backing member 23 is insertable from below, the backing member receiving the head of a screw 24 which, by way of a tapped hole 25 in the supporting member 21, ensures a releasable connection between the toe holder 3 and the sole plate 2. To double the range of adjustment for different boot sizes, the supporting member 21 of the toe holder 3 is provided with a second tapped hole 26.

Figure 6:
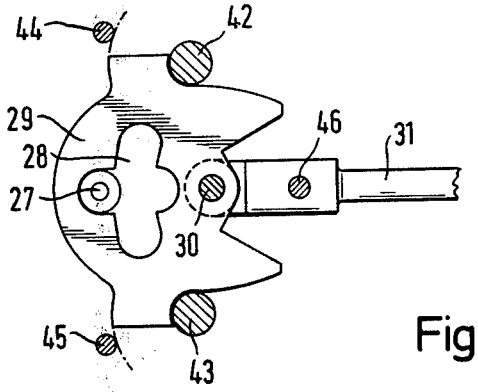
FIG. 6 is a plan view of part of the locking mechanism of the safety ski binding.

The Z-shaped angle 13 secured to the ski 1 at the heel zone of the ski boot has at its right-hand end in relation to FIG. 3 a pivot pin 27 which carries a slide roller at its upper end, the roller projecting into a guide groove 28 of a cam plate 29 which is shown in plan view in FIG. 6. The cam plate is pivoted by a pin 30 to a pull rod 31 which extends through a supporting wall 32 of the sole plate 2 on the right-hand side in relation to FIG. 3 and terminates in a screwthread 33 onto which there is screwed a bolt 34 having an internal screwthread. This bolt comprises a collar 35 against which there is supported one end of a compression spring 36 which is guided partly by the pull rod 31 and partly by the bolt 34 and at which the other end abuts the supporting wall 32 of the sole plate 2. The free end of the bolt 34 projects through a wall 37 bounding the sole plate 2 and is there provided with a slot 38 so that the stress of the compression spring 36 can be adjusted with the aid of a screwdriver.

To indicate the stress of the spring there is an angle member which is only partly visible in FIGS. 3 and 4; its one end is in the form of an annular plate 39 which is guided on the bolt 34 and held between the compression spring 36 and the collar 35 and its other end forms a pointer 40 which appears in a window 41 of the sole plate 2 (see FIG. 4).

Secured to the underside of the sole plate 2 and symmetrical to its longitudinal axis there are respective slide bolts 42, 43 and 44, 45 which rest against the outer edge of the cam plate 29 or abut same when it is pivoted (see FIG. 6). The slide bolts 42, 43 serve as counterbearings for the cam plate 29 which is loaded by the prestressed compression spring 36 by way of the pull rod 31, whereas the slide bolts 44, 45 are provided for additionally guiding the cam plate 29 when it is swung about one of the slide bolts 42, 43.

Figure 5:
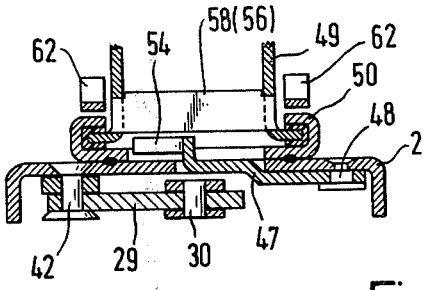
FIG. 5 is a part-sectional view of the locking mechanism of the safety ski binding taken on the lines V—V in FIG. 4.

On appropriate longitudinal displacement of the pull rod towards the right in FIGS. 3 and 4, an entrainment pin 46 secured in the pull rod 31 abuts a blocking lever 47 which is pivotably mounted in the sole plate 2 at 48 (see FIGS. 4 and 5). As will be evident from FIG. 5, the blocking lever is twice flanged upwardly in Z formation and projects through a guide plate 50 which is provided with apertures for the locking mechanism, receives a housing 49 of the automatic heel mechanism 5 and is secured to the sole plate 2 by means of rivets 51 (FIG. 3).

The free end of the blocking lever 47 comprises a recess 52 (see FIG. 4) which secures a supporting lever 54 in its position of FIGS. 3 and 4, the supporting lever being pivotably mounted by means of a pivot pin 53 fixed in the sole plate 2. By way of a slide roller 55 mounted at the free end of the supporting lever and a cross-member 56 in the housing 49, the supporting lever is subjected to the load of a compression spring 57 which is supported by the supporting wall 32 of the sole plate 2 on the one hand and by the housing 49 on the other hand. The cross-member which is somewhat oblique in the housing 49 (see FIG. 4) is subjected to a leaf spring 58 and not fixed on the loaded side, whereby there is a certain amount of longitudinal elasticity of the housing and thus of the automatic heel mechanism 5 in relation to the toe holder 3 fixed rigidly to the sole plate.

On the occurrence of a torsional load on the sole plate 2 exceeding the stress of the compression spring 36, the sole plate pivots in the appropriate direction about the pivot pin 8 fixed with respect to the ski. The slide bolts 42, 43 on the underside of the sole plate take the cam plate 29 along with them and the supporting wall 32 or the wall 37 the pull rod 31 and the bolt connected to it. However, the cam plate 29 cannot follow the sole plate 2 but is forced by the pivot pin 27 fixed with respect to the ski to pivot about the slide bolt 42 or 43 which is at the rear with respect to the motion of the sole plate, until the slide roller of the pivot pin 27 is disposed in that part of the guide groove 28 which extends towards the tip of the ski. Since the pull rod 31 is pivoted to the cam plate, every pivoting movement of the sole plate first gives rise to a longitudinal displacement of the pull rod against the force of the compression spring 36, whereby the stress of the spring is increased.

With an increase in the torsional force on the sole plate 2 until the releasing force is reached, the cam plate 29 is swung so far that the part of the guide groove 29 extending towards the tip of the ski is released from the slide roller of the pivot pin 27 and the slide roller is now received by the trailing end of the guide groove extending substantially transversely to the length of the sole plate. These ends of the guide groove are so shaped that the force of the compression spring 36 remains constant despite the continued turning of the sole plate.

The point of release is reached when the entrainment pin 46 pivots the blocking lever 47 as a result of the longitudinal displacement of the pull rod 31 towards the tip of the ski, whereby retainment of the supporting lever 54 and thus of the automatic heel mechanism 5 is suddenly released. By reason of the relaxing compression spring 57, the housing 49 and, with it, the entire automatic heel mechanism 5 consisting of the sole retainer 59, freeing lever 60 and a releasing mechanism (not shown) for frontal fall loading is displaced in the guide plate 50 towards the end of the ski so that the boot of the skier is released from the binding. Movement of lever 60 to free the binding is conventional, for instance, see the previously cited U.S. Patents, especially U.S.

Pat. No. 3,909,023. The cross-member 56 in the housing 49 takes the supporting lever 54 with it and pivots same in the counter-clockwise direction in FIG. 4 against the force of a bending spring 61 which is coiled about the upper end of the pivot pin 53. The displacement of the automatic heel mechanism 5 towards the end of the ski is limited by two abutments 62 (see FIG. 4) on the guide plate 50 and two lugs 63 (see FIG. 3) serving as counter-abutments on the freeing lever 60.

By release of the ski boot from the binding, the torsional load of the sole plate 2 acting on the compression spring 36 suddenly disappears so that the sole plate is automatically swung back to its illustrated starting position by the relaxing compression spring 36.

To step into the safety ski binding again after a rotary fall release, the sole retainer 59 is opened by swinging the freeing lever 60 upwardly, as is usual for most conventional step-in bindings for instance, the binding described in U.S. Pat. No. 3,909,023. During this movement of the freeing lever, the two lugs 63 are supported against the abutments 62 and roll in a manner similar to a pinion on a rack, whereby the automatic heel mechanism 5 is again displaced towards the tip of the ski. This relieves the supporting lever 54 which swings back under the force of the coiled bending spring 61, during which time it first somewhat takes along with it the blocking lever 47 which is subjected to a somewhat weaker coiled bending spring 64 and then, after reaching its end position, engages in the recess 52 of the blocking lever. The safety ski binding is then ready for stepping in.

I claim:

1. A safety ski binding comprising a sole plate which is rotatably mounted on the ski surface in the heel region of the ski boot on a pivot extending perpendicular to the ski surface, is secured against lifting off, has a toe holder at its front end and has at its rear end a spring-loaded automatic heel mechanism for the ski boot that has a sole retainer and a first spring whose force must be overcome to allow upward movement of the sole retainer to release the ski boot on the occurrence of a frontal fall load exceeding the spring resistance of the first spring, characterized in that slideways are secured to the upper surface of the ski, in that the sole plate has slideways extending transverse to the longitudinal direction of the ski in the toe and heel regions of the ski boot that are engageable with the slideways secured to the ski for securing the sole plate against lifting off, and in that the automatic heel mechanism has a separate spring exerting a force opposing release of the ski boot on the occurrence of a rotary fall so that release takes place on the occurrence of an excessive rotary fall only after overcoming the resistance of the separate spring, said automatic heel mechanism further comprising a housing mounted on the sole plate for displacement lengthwise of the ski and carrying said sole retainer, a third spring supported on the sole plate for exerting a force moving the housing in a release direction of the automatic heel mechanism, and lock means for preventing movement of said housing by said third spring, said separate spring exerting a force on said lock means such that said lock means is moved into a position releasing said housing after said sole plate has pivoted a predetermined amount about its pivot.

2. A safety ski binding according to claim 1, characterised in that the automatic heel mechanism (5) comprises a freeing lever (60) provided with a lug (63) which forms the counter-abutment for an abutment (62) on the sole plate (2) limiting the displacement of the housing (49).

3. A safety ski binding particularly according to claim 1, characterised in that the sole plate (2) is mounted on the ski (1) for deliberate removal.

4. A safety ski binding according to claim 3, characterised in that the sole plate (2) is secured on the ski (1) by means of a bayonet coupling (11).

* * * * *